United States Patent [19]

Cumming et al.

[11] Patent Number: 4,750,080

[45] Date of Patent: Jun. 7, 1988

[54] FILM CLEANER METHOD AND APPARATUS

[75] Inventors: Newell E. Cumming; James E. Sidell, both of Encino, Calif.

[73] Assignee: Cumming Corporation, Chatsworth, Calif.

[21] Appl. No.: 14,729

[22] Filed: Feb. 13, 1987

[51] Int. Cl.[4] ..... H05F 3/06

[52] U.S. Cl. ..... 361/213; 361/229; 361/230; 361/231

[58] Field of Search ..... 361/213, 229, 230, 235

[56] References Cited

U.S. PATENT DOCUMENTS 3,414,769 12/1968 Hoffman ..... 361/235
4,194,232 3/1980 Cumming et al. ..... 361/213
4,333,123 6/1982 Moulden ..... 361/213
4,486,808 12/1984 Cardone ..... 361/235

OTHER PUBLICATIONS

Introduction to Circuits by Lee W. Churchman, pp. 456, 457, published by Holt, Rinehart and Winston, New York, 1976.

*Primary Examiner*—L. T. Hix
*Assistant Examiner*—D. Rutledge
*Attorney, Agent, or Firm*—William W. Haefliger

[57] ABSTRACT

A method of cleaning film includes:

(a) providing a cleaning zone and passing film laterally through that zone, (b) providing streams of gas flowing toward opposite sides of the film as it passes in said zone, and (c) supplying ions of opposite polarity to the air streams and in cyclically reversing polarity relation.

4 Claims, 4 Drawing Sheets

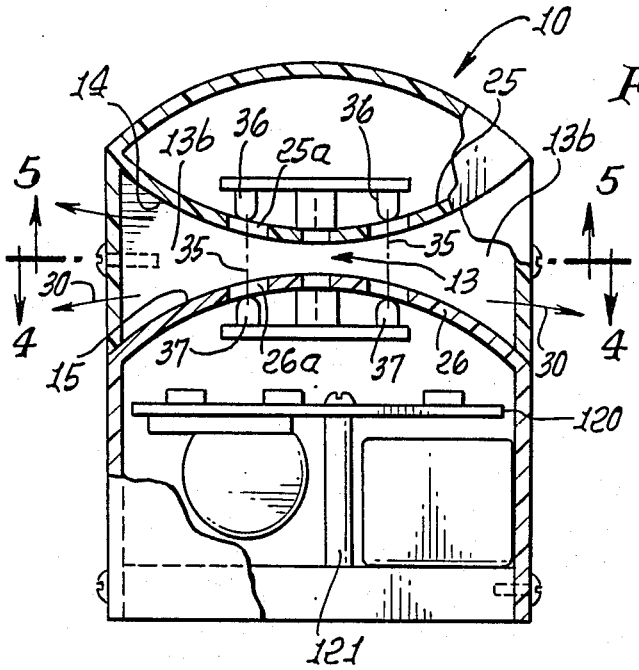
FIG. 2a.
FIG. 3.
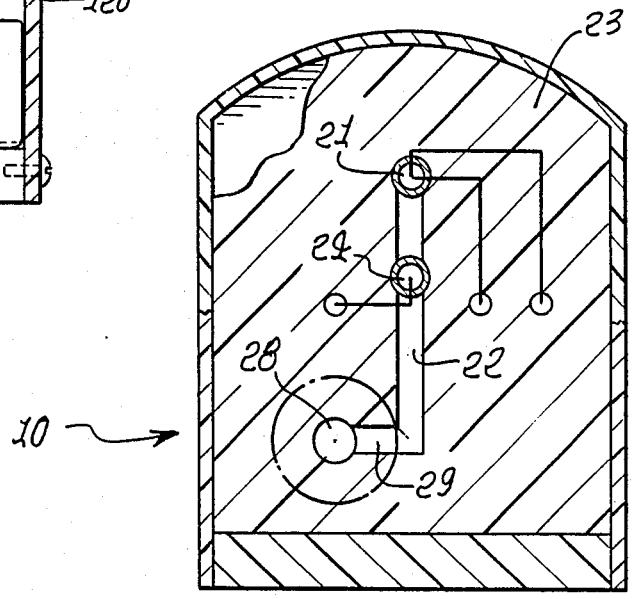
FIG. 4.
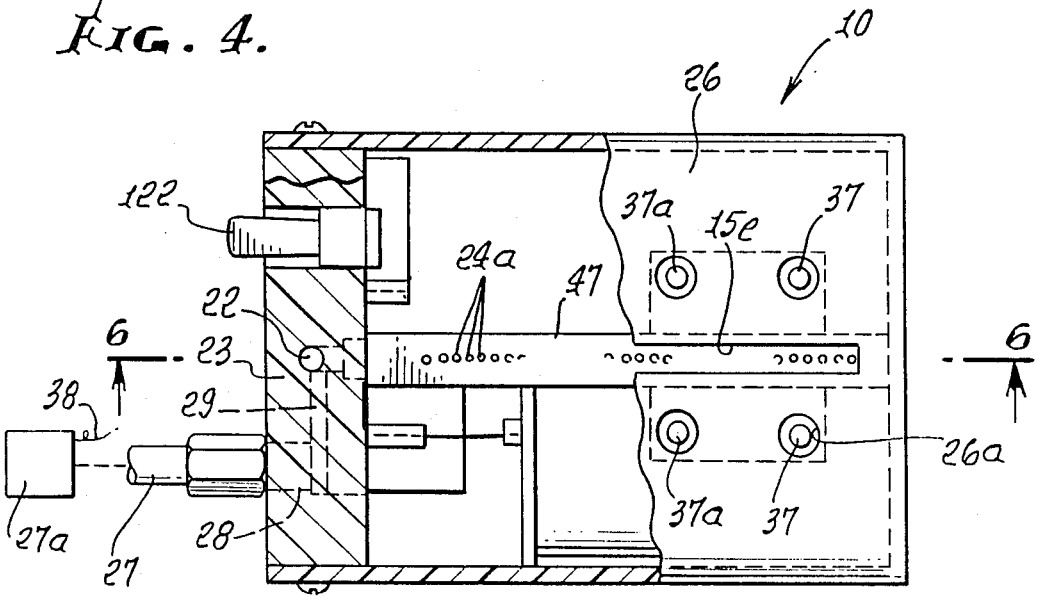

FIG. 5.
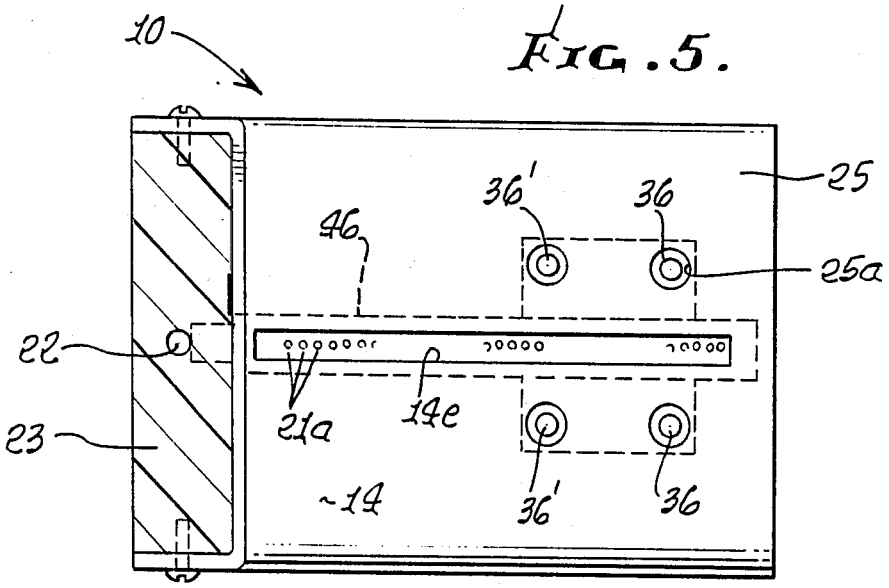
FIG. 6.
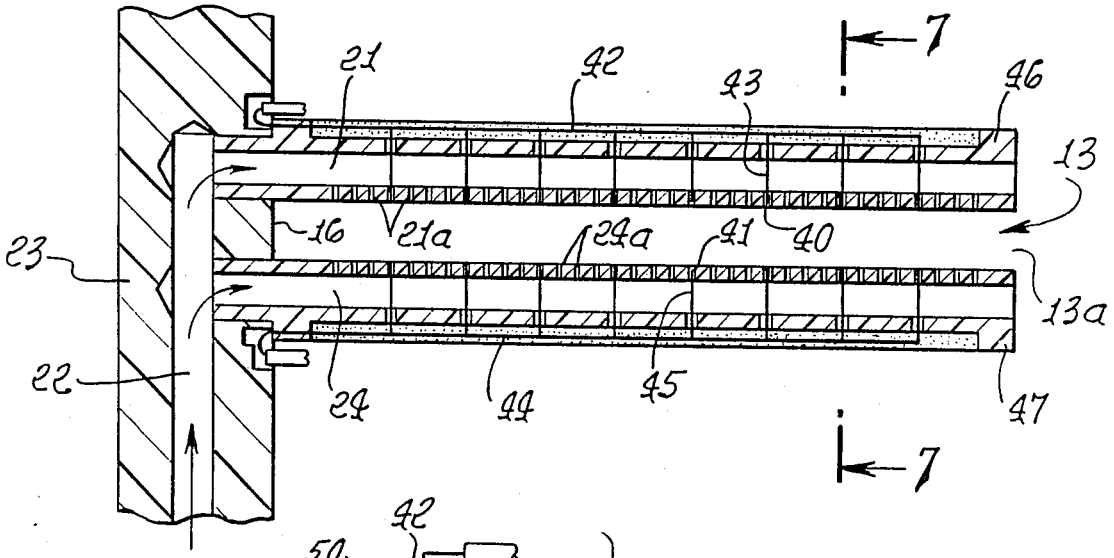
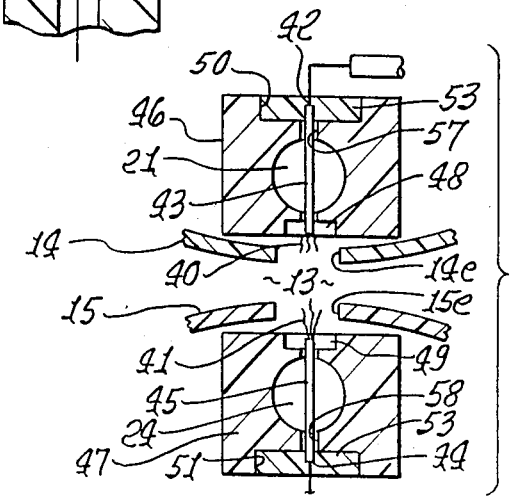
FIG. 7.

TIME
VOLTAGE
UPPER BAR TIPS
LOWER BAR TIPS
70
80
81
82
83
84
85
88
89
90
91
92
93
40
41
42
44
104
105
106
107
108
109
110
111
112
113
122
36
36'
37
37'
72
72a
72b
72c
73
73a
73b
73c

FILM CLEANER METHOD AND APPARATUS

BACKGROUND OF THE INVENTION

This invention relates generally to treatment of photographic film, and more particularly concerns removal of dust from film slide surfaces as well as elimination of static on such surfaces, so as to remove dust from film.

In the past, devices have been constructed which employe nuclear pellets to ionize air which is blasted over film. The cost of such equipment is objectionable, in view of the need for frequent replacement of the nuclear pellets, which are individually expensive.

SUMMARY OF THE INVENTION

It is a major object of the present invention to provide apparatus and method to overcome the above problems and heavy expense. Basically, the apparatus comprises:

(a) first means forming a cleaning zone to receive film passed through said zone, (b) second means for passing streams of gas flowing toward opposite sides of the film as it passes in said zone, (c) and third means for supplying ions of opposite polarity to said gas streams and in cyclically reversing polarity relation.

As will be seen, the third means includes circuitry for cyclically reversing the polarity of ions supplied to each of two gas streams, one gas stream flowing toward one side of the film and another gas stream flowing toward the opposite side of the film; the polarity of ions supplied to said one stream is positive when the polarity of ions supplied to the other stream is negative, and vice versa; fine wire clusters are provided to have ion dispensing tips at upper and lower sides of the cleansing zone; and a succession of half cycle voltages are applied to the tips exposed to each of said streams, and characterized in that the half cycles are alternately positive and negative to said tips.

In addition, means is provided for initiating said supply of ions when film is introduced into the cleansing zone; such means provides electromagnetic beams passing crosswise through said zone to be interrupted by the film in that zone, and effecting said initiation in response to said interruption; and typically four of the beams are passed through said zone, and causing the gas to flow into said zone to pass through two of said beams at one side of said zone and to pass through another two of said beams at the opposite side of said zone. Further, the third means may advantageously include cables in bars connected to opposite end taps of a transformer secondary coil which is center tapped to ground, and cable branches have ion dispensing terminal fine wire clusters exposed to the cleaning zone at upper and lower sides thereof.

As a result, much lower voltage is needed to effect the same degree of cleaning of film as in prior apparatus (i.e. about±1,400 VAC, as compared with prior then required voltage±4,000 VAC); and the apparatus is simpler, more rugged and more reliable, ensuring dust free, static free film negatives for printing and/or duplicating, without use of brushes or wipers.

These and other objects and advantages of the invention, as well as the details of an illustrative embodiment, will be more fully understood from the following specification and drawings, which:

DRAWING DESCRIPTION

Figure 2:
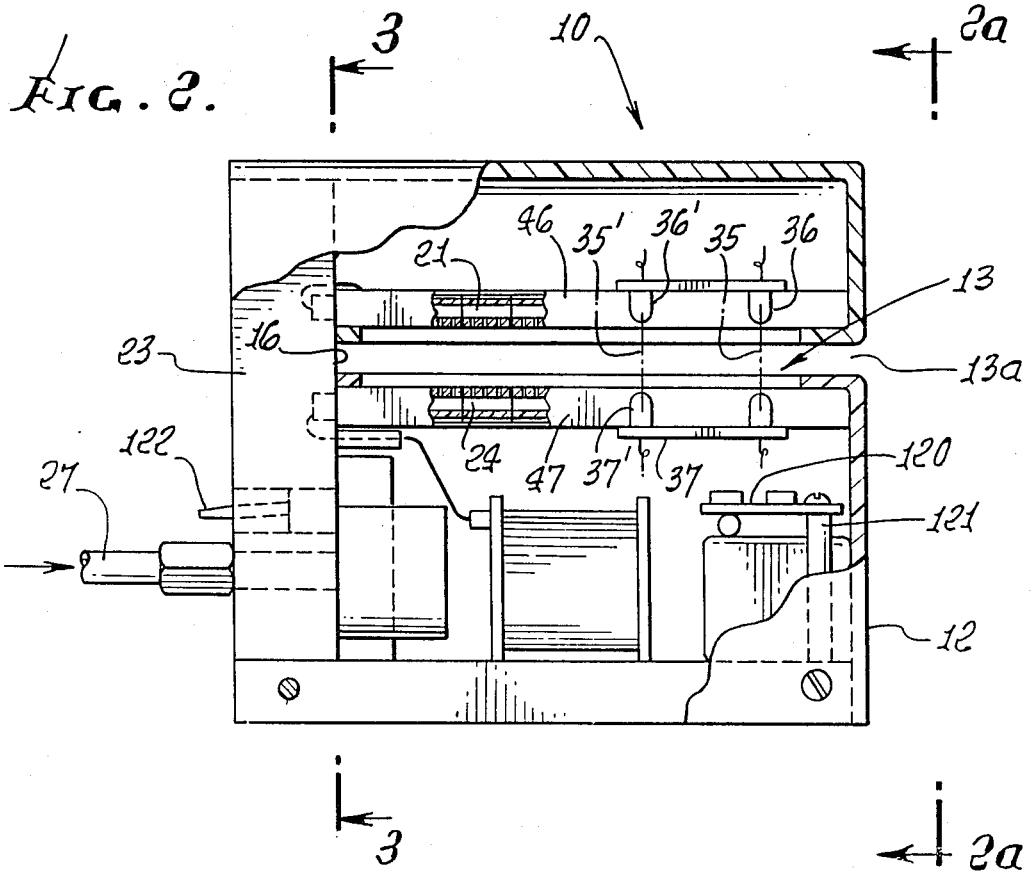
FIG. 2 is a side elevation, taken in section through the FIG. 1 apparatus.

FIG. 2*a* is an end elevation taken on lines 2*a*—2*a* of FIG. 2;

FIG. 3 is a vertical section taken on lines 3—3 of FIG. 2;

FIG. 4 is a plan view, looking downwardly, taken on lines 4—4 of FIG. 2*a;*

FIG. 5 is a section on lines 5—5 of FIG. 2*a;*

Figures 8, 9:
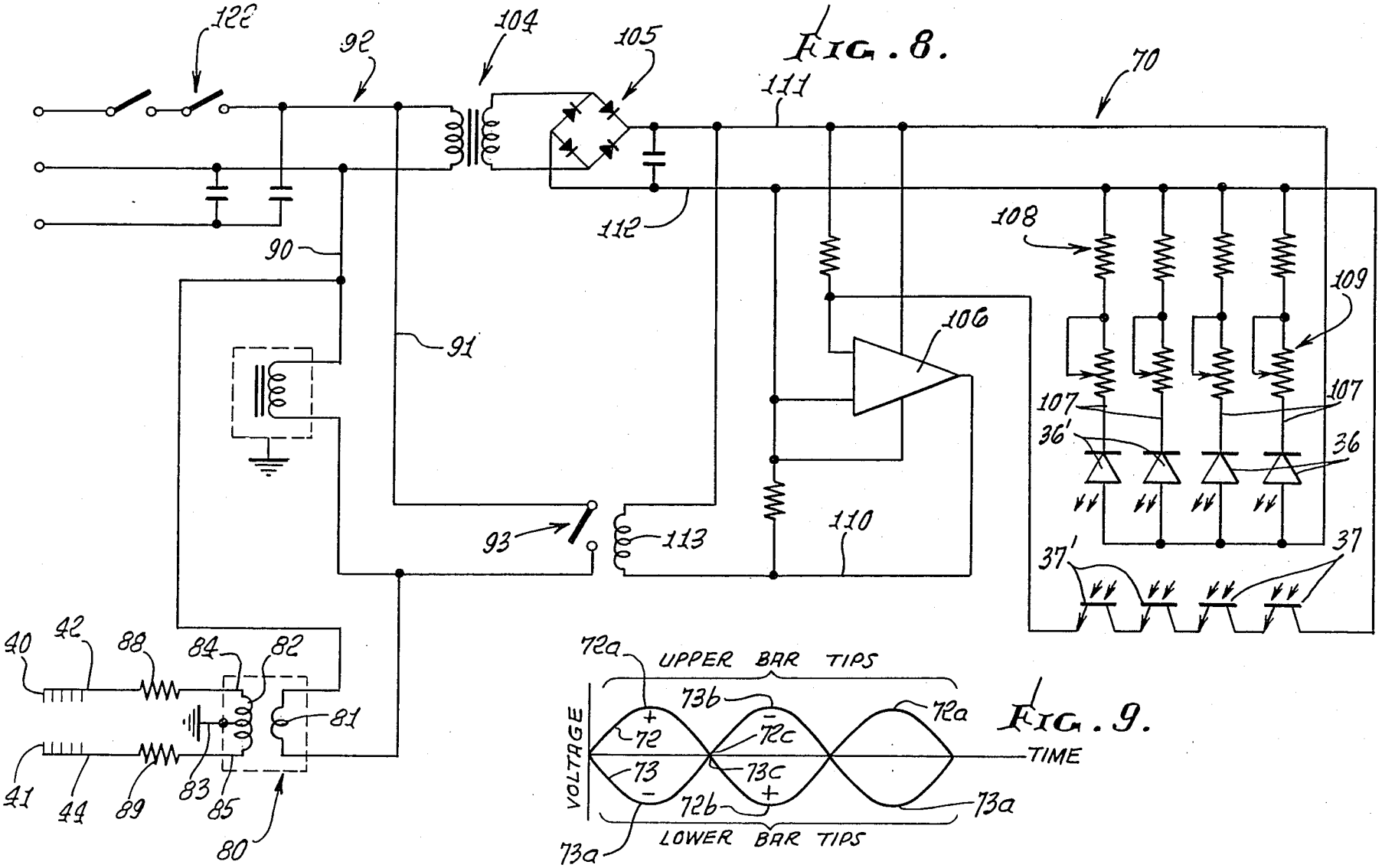

FIG. 6 is an enlarged fragmentary view taken in elevation on lines 6—6 of FIG. 4;

FIG. 7 is a section on lines 7—7 of FIG. 6;

FIG. 8 is a circuit diagram; and

FIG. 9 is a voltage polarity timing diagram, as applied to upper and lower ion dispensing tips.

DETAILED DESCRIPTION

Figure 1:
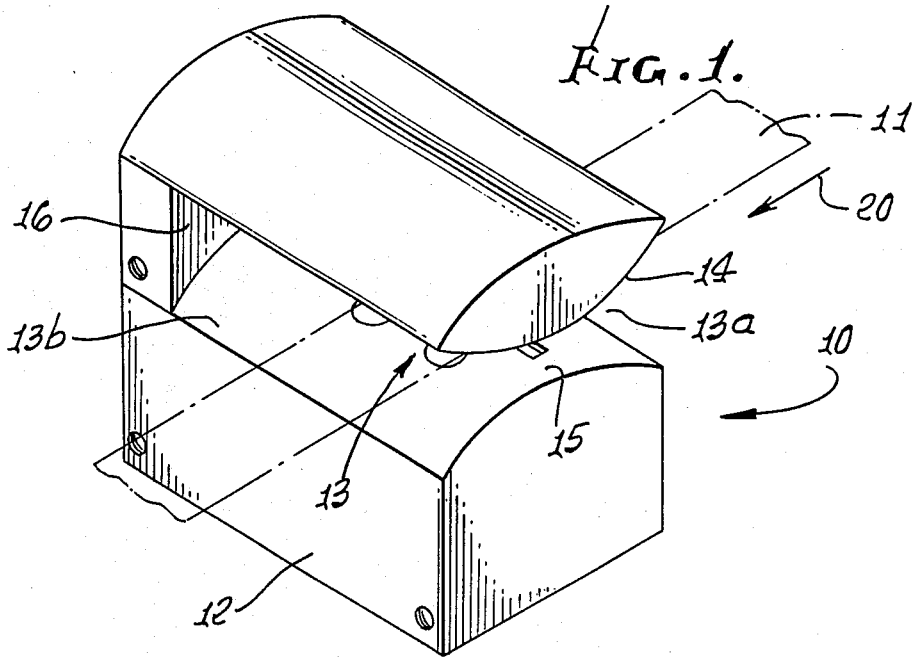
FIG. 1 is a perspective view showing apparatus in accordance with the invention.

In FIGS. 1–7, the apparatus 10 for treating photographic film 11 (which may include microfiche) includes a support 12 and means associated with the support defining a film treatment zone 13 in the shape of a recess having a front opening 13*a* and opposite side openings 13*b*. The latter are spaced apart laterally to pass the film through the zone 13 which typically has venturi shape as seen in FIG. 1. Such means may comprise upper and lower curved surfaces 14 and 15. Surface 14 is downwardly convex in end elevation as seen in FIG. 2*a*. Surface 15 is upwardly convex in elevation as seen in FIG. 2*a*. A support or body wall 16 closes the rear side of recess 13.

Means is also provided to supply streams of pressurized gas such as air or nitrogren to zone 13, and closely adjacent opposite faces of film 11 passing laterally through the treatment zone. See in this regard the travel direction indicated by arrows 20 in FIG. 1. Such means may include the upper duct 21 in the support body above zone 13, the lower duct 24 in the body below zone 13, and supply duct 22 in wall 23. A compressed air supply is indicated at 27, with lines 28 and 29 leading to ducts 22, 23 and 24 as indicated. Outlets from the branch ducts 21 and 24 appear at 21*a* and 24*a* facing a throat portion of zone 13. Accordingly, dust is swept off the upper and lower sides of the film as it passes through the zone 13. The gaseous streams tend to flow laterally beyond the recess ends 13*b* in FIG. 2*a* as indicated by arrows 30.

FIG. 2*a* shows two photoelectric beams 35 passing from generators 37 to detectors 36, at opposite sides of the throat region. Beams 35 pass through openings 25*a* in curved wall 25 and openings 26*a* in a curved wall 26 An additional and redundant pair of beams 35' is provided between generators 36' and detectors 37'. Upon interruption of either beam, as by entry of the film into recess or zone 13, an air supply motor 27*a* is activated, to drive the air supply pump (for example) whereby air is automatically supplied to zone 13 only when the film is in zone 13. An electrical connection from detectors 37 to the motor 27*a* is indicated at 38.

Also provided is apparatus to supply ions of opposite polarity to the gas streams flowing toward opposite sides of the film and in cyclically reversing polarity relation. Such means includes ion dispensing tips 40 and 41 exposed to the zone 13 and the air or gas streams in such zones. Downward facing tips 40 are supplied with high voltage as by main cable 42 and cable branches 43 extending downwardly through duct 21, and upward facing and projecting tips 41 are supplied with high voltage as by main cable 44 and cable branches 45 extending upwardly through duct 22. See FIG. 7 shows synthetic resinous and insulative, elongated bars 46 and 47 of rectangular outline that form ducts 21 and 22 and carry the cables, branches and tips located at the branch terminals. Multiple tips in the form of clusters of fine wires (platinum, for example) are formed to yield best results in terms of flooding the zone 13 with ions, and redundancy of tips to assure workability enhanced ion production.

Tips 40 extend in recesses 48 in bar 46, and tips 41 extend in recesses 49 in bar 47, those recesses formed between groups of the outlets 21*a* and 24*a*, as is clear from FIG. 6. Other recesses 50 and 51 in the bars receive the main cables 42 and 44, about which insulations resinous material 53 is filled in or potted, as seen in FIG. 7. If desired, small ports 57 and 58 may be formed in bars 46 and 47 to pass air about branches 43 and 45 to recesses 48 and 49, to sweep ions off the fine wire tips, and toward the opposite sides of the film.

Further, the ion supply means typically includes circuitry 70 (see FIG. 8, for example) for cyclically reversing the polarity of ions supplied to each of two of the gas streams, one stream or streams flowing toward one side of the film, and the other stream or streams flowing toward the opposite side of the film. Reference to FIG. 9 shows that high positive voltage 72 is supplied to the tips at the upper bar to peak at 72*a*, and then to the tips at the lower bar to peak at 72*b*, etc. in cyclic relation; and that high negative voltage 73 is supplied to the tips at the upper bar to peak at 73*b*, and then again to the tips at the lower bar to peak again at 73*a*, etc. Positive peaks 72*a* are opposite peaks 73*a* (i.e. occur simultaneously); and peaks 73*b* are opposite peaks 72*b*. Also, see cyclic nodes 72*c* and 73*c* occurring simultaneously, between the peaks. It is therefore seen that each side of the film, at the throat of the venturi where gas velocity streams are greatest, is successively and rapidly (60 Hertz for example) subject to oscillation of high voltage between positive and negative peaks, so that dust particles are subjected to optimized electrostatic field differentials. A succession of half cycle high voltages, alternately positive and negative DC, i.e. alternating DC pulses, are applied to the tips. This is important when it is considered that the film passes randomly closer to or further from one or the other of the two surfaces 14 and 15, near throat openings in the surfaces to pass the ions and air streams applied at 14*e* and 15*e*.

Circuitry to develop the high voltage wave forms 72 and 73 is shown in FIG. 8. It includes a transformer 80 having primary and secondary coils 81 and 82. The secondary 82 is center-tapped to ground, at 83. The end terminals 84 and 85 of the coil 82 are respectively connected at 42 and 44, and via resistors 88 and 89 to the emitters or tips, indicated at 40 and 41, and as described previously. The end terminals of the primary coil are connected, as indicated at 90 and 91, across the 60 cycle 120 volt line 92, switch 93 (relay for example) connected in line 91.

Supply circuitry for the phototransistors, described previously at 36 and 37, is indicated as including transformer 104, rectifier bridge 105, operational amplifier 106, and four lines 107 leading via resistors 108 and 109 to the beam generators 36 and 36' and the detectors (phototransistors) 37 and 37'. When any of the beams is interrupted by film passage, amplifier 106 causes flow of current in line 110, i.e. across lines 11 and 111, energizing the relay coil 113 and closing switch 93. This in turn effects ion transmission by emitters 40 and 41, as described.

A circuit board 120 is mounted at 121; and an ON/-OFF switch appears at 122.

*We claim:*

1. Method of cleaning photographic film that includes:

(a) providing a venturi shaped cleaning zone between upper and lower hollow bars and passing film laterally through that zone, (b) providing streams of air flowing through said bars via holes directed toward said zone so that the gas streams flow toward opposite sides of the film as it passes in said zone, and (c) supplying ions of opposite polarity to said air streams and in cyclically reversing polarity relation, thereby cyclically reversing the polarity of ions supplied to each of two air streams one air stream flowing toward one side of the film via holes in the upper bar and another air stream flowing toward the opposite side of the film via holes in the lower bar, the polarity of ions supplied to said one air stream being positive when the polarity of ions supplied to the other air stream is negative, and vice versa, the film passing randomly through said zone with time varying spacing from said upper and lower bars, (d) and wherein ion dispensing tips are exposed to said air streams, and wherein cyclically varying high voltages are applied to said tips to that positive voltages peak as applied to tips exposed to air streams flowing toward one side of said zone at the same time that negative voltages peak as applied to tips exposed to air streams flowing toward the opposite side of said zone, and vice versa, with zero voltage node levels applied to all tips, simultaneously and cyclically, the zero voltage nodes occurring simultaneously, (e) initiating said supply of ions when film is caused to randomly enter said zone, and stopping said supply of ions when film completely leaves said zone, (f) providing two electromagnetic beams passing crosswise through said zone at the film entrance side thereof, and two electromagnetic beams passing crosswise through said zone at the film exit side thereof, (g) causing air flowing into said zone via each of said bars to flow through all of said beams, at said entrance and exit sides of the zone, initiating said supply of ions when the randomly moving film intercepts one or both of the beams at the entrance to said zone, and stopping said supply of ions when the film ceases to intersect the beams at the exit side of said zone.

2. The method of claim 1 wherein a succession of half cycle voltages are applied to the tips exposed to each of said streams, and characterized in that the half cycles are alternately positive and negative DC voltages.

3. In apparatus for cleaning film, the combination comprising (a) first means forming a cleaning zone to receive film passed through said zone, (b) second means for passing streams of gas flowing toward opposite sides of the film as it passes in said zone, (c) and third means for supplying ions of opposite polarity of said gas streams and in cyclically reversing polarity relation, (d) and including means for initiating said supply of ions when film is introduced into the cleaning zone, (e) said last named means including means providing electromagnetic beams passing crosswise through said zone to be interrupted by the film in that zone, and effecting said initiation in response to said interruption, four of said beams being passed through said zone, there being upper and lower hollow bars having outlet ports located to cause the gas to flow into said zones to pass through two of said beams at one side of said zone and to pass through another two of said beams at the opposite side of said zone, (f) said third means including cables in said bars connected to opposite end taps of a transformer secondary coil which is center tapped to ground, and cable branches having ion dispensing terminal fine wire clusters exposed to said cleaning zone at upper and lower sides thereof, (g) said third means including circuitry for cyclically reversing the polarity of ions supplied to each of two gas streams, one gas stream flowing toward one side of the film and another gas stream flowing toward the opposite side of the film, the polarity of ions supplied to said one stream being positive when the polarity of ions supplied to the other stream is negative, and vice versa.

4. The apparatus of claim 3 wherein a succession of half cycle voltages are applied to the tips exposed to each of said streams, and characterized in that the half cycles are alternately positive and negative DC voltages, said zone being venturi-shaped, and the hollows in said bars surrounded by insulative resinous material, the fine wires projecting in said material.

* * * * *